US008602262B2

(12) United States Patent
Schmidt et al.

(10) Patent No.: US 8,602,262 B2
(45) **Date of Patent: *Dec. 10, 2013**

(54) INTERLOCKING MECHANISM FOR A FLUID DISPENSER

(71) Applicant: Sports Solutions, Inc., Dallas, TX (US)

(72) Inventors: Laurie Schmidt, Dallas, TX (US); John Wiseman, Lewisville, TX (US)

(73) Assignee: Sports Solutions, Inc., Dallas, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/670,114

(22) Filed: Nov. 6, 2012

(65) Prior Publication Data

US 2013/0062367 A1 Mar. 14, 2013

Related U.S. Application Data

(63) Continuation of application No. 12/618,361, filed on Nov. 13, 2009, now Pat. No. 8,302,818.

(51) Int. Cl.
*B67B 1/00* (2006.01)

(52) U.S. Cl.
USPC ..... 222/153.03; 222/129; 222/153.01; 222/181.3; 222/192; 70/167

(58) Field of Classification Search
USPC ..... 222/129, 130–132, 192, 153.01, 222/153.03, 153.09, 153.14, 181.3; 70/163, 70/167, 171, 413, 455, 456 R, 456 B
See application file for complete search history.

(56) References Cited

U.S. PATENT DOCUMENTS

| | | | | |
|---|---|---|---|---|
| 4,874,113 | A | 10/1989 | Schmidt | |
| 5,253,786 | A | 10/1993 | Schmidt | |
| D620,735 | S | 8/2010 | Schmidt | |
| D625,132 | S | 10/2010 | Schmidt | |
| D626,366 | S | 11/2010 | Schmidt | |
| D627,153 | S | 11/2010 | Schmidt | |
| 8,302,818 | B2 * | 11/2012 | Schmidt et al. | 222/153.03 |

* cited by examiner

*Primary Examiner* — Frederick C Nicolas
(74) *Attorney, Agent, or Firm* — Howison & Arnott, L.L.P.

(57) ABSTRACT

An interlocking mechanism for a fluid dispenser includes a container body and a top portion. The container body includes a first sidewall having a first slot therein and a second sidewall having a second slot therein. The top portion includes a first lock channel, a first magnet adjacent to the first lock channel, a second lock channel, and a second magnet adjacent to the second lock channel. A first sliding lock member is positioned within and slidable along the first lock channel. The first sliding lock member has a tip portion configured to engage and disengage with the first slot, and a base portion having a third magnet disposed therein.

15 Claims, 9 Drawing Sheets

INTERLOCKING MECHANISM FOR A FLUID DISPENSER

CROSS-REFERENCE

This application is a continuation of U.S. patent application Ser. No. 12/618,361, filed Nov. 13, 2009, entitled INTERLOCKING MECHANISM FOR A FLUID DISPENSER, now U.S. Pat. No. 8,302,818, issued on Nov. 6, 2012, the specification of which is incorporated herein in its entirety.

TECHNICAL FIELD

The present invention relates to an interlocking mechanism for securing a top of a fluid dispenser.

BACKGROUND

In fitness centers, health spas, and other facilities it is often desirable for the management of the facility to provide dispensing containers for dispensing fluids, such as lotions, soap, or shampoo, to the users of the facilities. However, the management may also desire to prevent unauthorized tampering with the contents of the dispensing containers.

SUMMARY OF THE INVENTION

The present invention discloses, in one aspect thereof, an interlocking mechanism for a fluid dispenser that includes a container body including a first sidewall having a first slot therein and a second sidewall having a second slot therein, and a top portion. The top portion includes a first edge wall, a second edge wall, a third edge wall, and an inner surface. The top portion further includes a first lock channel positioned along a portion of the inner surface and extending to the second edge wall, and a first magnet disposed on the inner surface adjacent to the first lock channel. The top portion still further includes a second lock channel positioned along a portion of the inner surface and extending to the third edge wall, and a second magnet disposed on the inner surface adjacent to the second lock channel. A first sliding lock member is positioned within and slidable along the first lock channel. The first sliding lock member has a tip portion configured to engage and disengage with the first slot, and a base portion having a third magnet disposed therein. A first attractive magnetic force is applied between the first magnet and the third magnet to slide the first sliding lock member into an engaged position with the first slot. A second sliding lock member is positioned within and slidable along the second lock channel. The second sliding lock member has a tip portion configured to be engaged and disengaged with the second slot, and a base portion having a fourth magnet disposed therein. A second attractive magnetic force is applied between the second magnet and the fourth magnet to slide the first sliding lock member into an engaged position with the second slot.

BRIEF DESCRIPTION OF THE DRAWINGS

For a more complete understanding, reference is now made to the following description taken in conjunction with the accompanying Drawings in which.

DETAILED DESCRIPTION

Figure 2A:
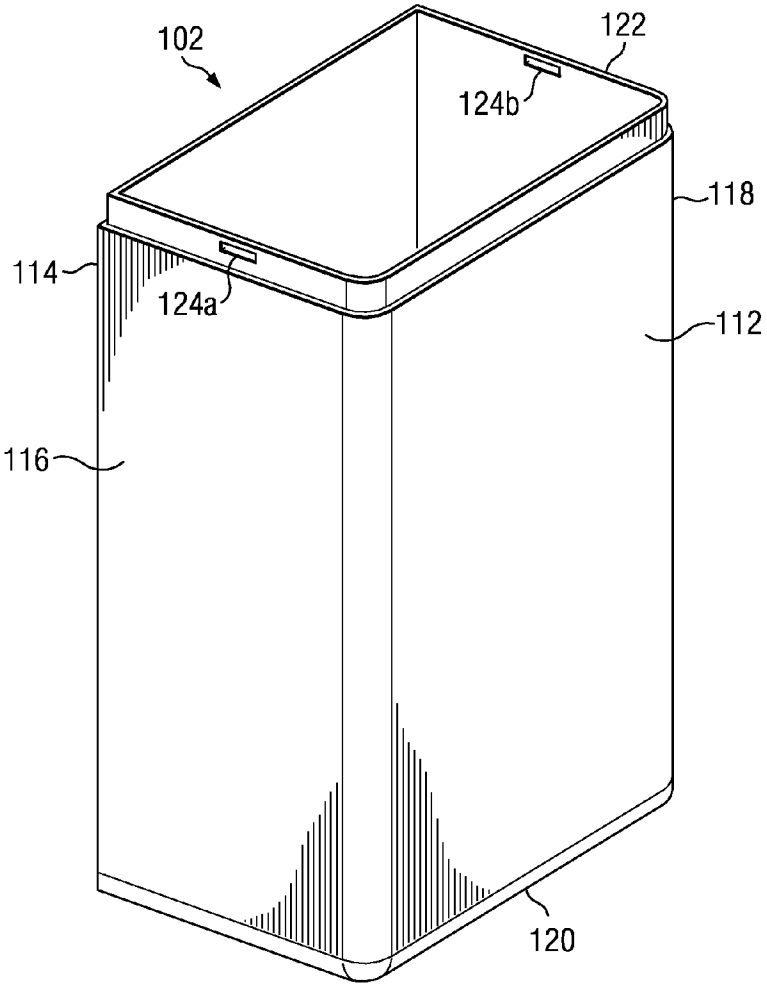
FIGS. 2A-2D illustrate the container body of the fluid dispenser with interlocking top mechanism of FIG. 1.

Referring now to the drawings, wherein like reference numbers are used herein to designate like elements throughout, the various views and embodiments of an interlocking mechanism for a fluid dispenser are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Figure 1:
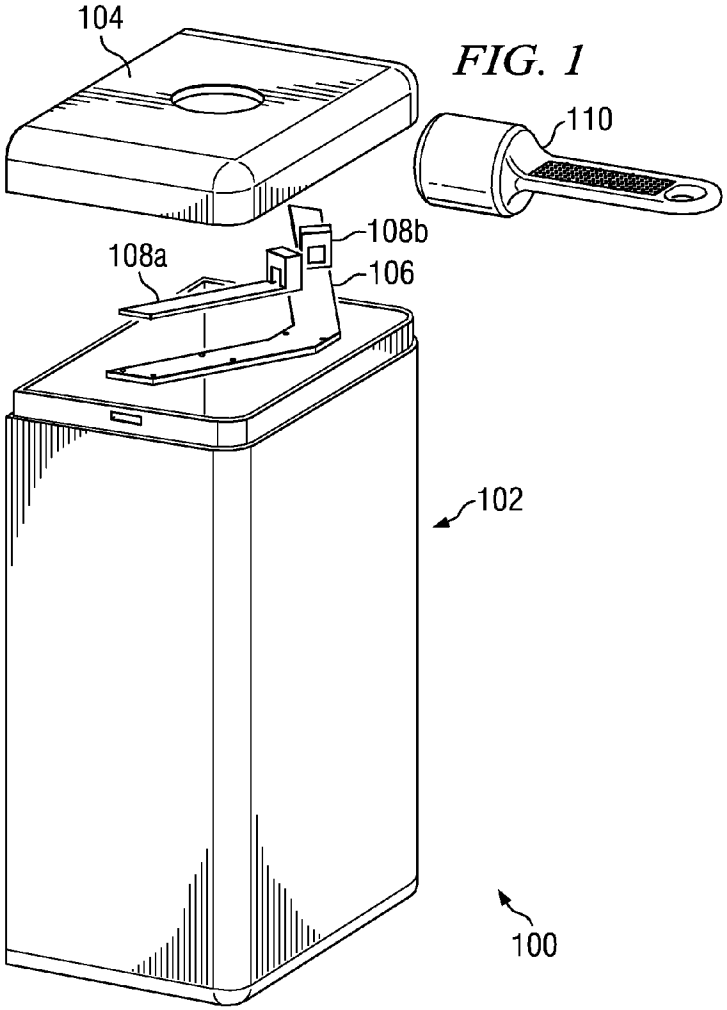
FIG. 1 illustrates an exploded perspective view of a fluid dispenser with interlocking top mechanism.

FIG. 1 illustrates an exploded perspective view of a fluid dispenser with interlocking top mechanism 100. The fluid dispenser 100 includes a container body 102, a locking top 104, an inside cover plate 106, a first sliding lock member 108*a*, a second sliding lock member 108*b*, and a key fob 110. In various examples, the locking top 104 is configured to mate with the container body 102, and the first sliding lock member 108*a* and the second sliding lock member 108*b* are configured to engage with the container body 102 to prevent removal of the locking top 104 from the container body 102 and access to contents of the container body 102. In at least one example, the first sliding lock member 108*a* and the second sliding lock member 108*b* are configured to engage the container body 102 through the application of one or more attractive magnetic forces between each of the first sliding lock member 108*a* and second sliding lock member 108*b* and portions of the locking top 104. Upon a user placing the key fob 110 proximate to or against the locking top 104, the first sliding lock member 108*a* and the second sliding lock member 108*b* are configured to disengage from the container body 102, thus permitting removal of the locking top 104 from the container body 102. In at least one example, the first sliding lock member 108*a* and the second sliding lock member 108*b* are configured to disengage from the container body 102 via application of an attractive magnetic force between the key fob 110 and the first sliding lock member 108*a* and the second sliding lock member 108*b*.

Figure 2B:
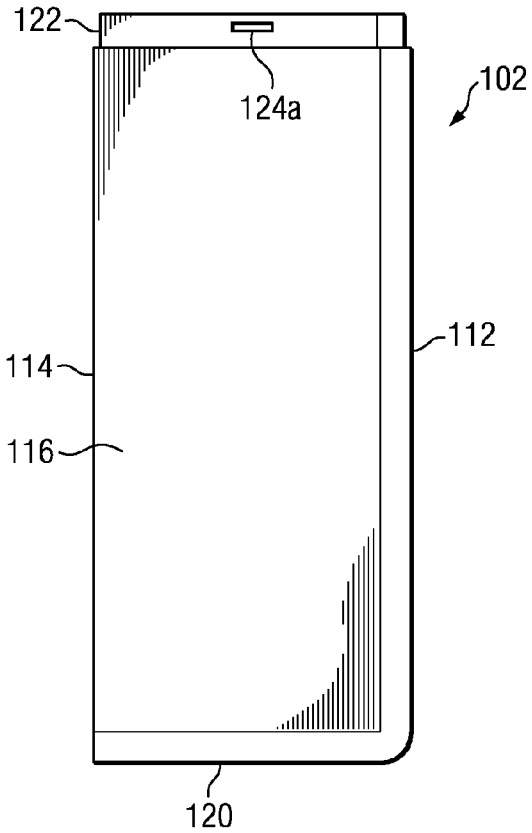
Figure 2C:
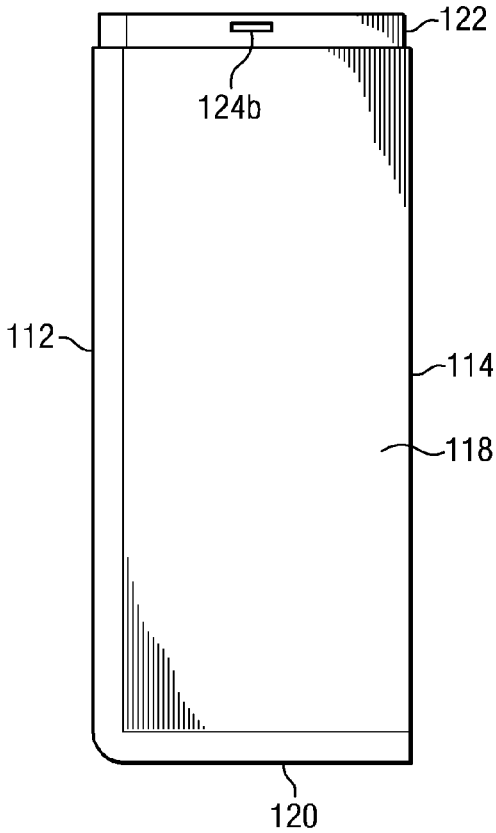
Figure 2D:
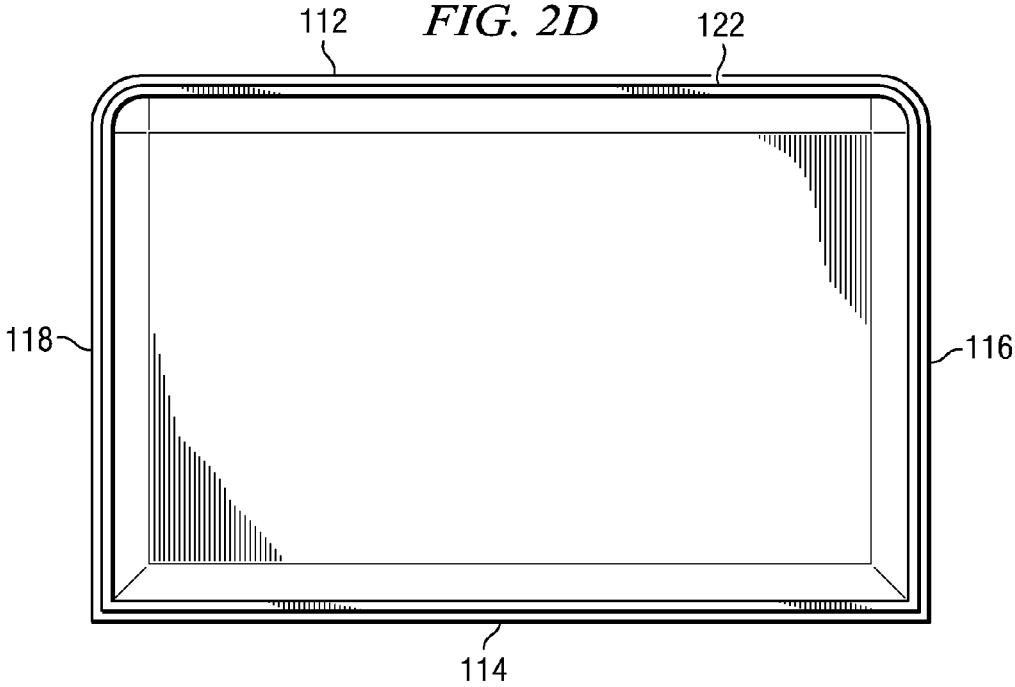

FIGS. 2A-2D illustrate the container body 102 of the fluid dispenser with interlocking top mechanism 100 of FIG. 1. FIG. 2A illustrates a perspective view of the container body 102. FIG. 2B illustrates a left side view of the container body 102. FIG. 2C illustrates a right side view of the container body 102. FIG. 2D illustrates a top view of the container body 102. In the illustrated example, the container body 102 includes a container front wall 112, a container rear wall 114, a container left sidewall 116, a container right sidewall 118, and a container bottom 120. In FIGS. 2A-2D, the container front wall 112 and the container left sidewall 116 intersect along a substantially curved edge, and the container rear wall 114 and the container left sidewall 116 intersect along a substantially straight edge. The container front wall 112 and the container right sidewall 118 intersect along a substantially curved edge, and the container rear wall 114 and the container right sidewall 118 intersect along a substantially straight edge. In the illustrated example, the container bottom 120 intersects the container front wall 112, the container left sidewall 116, and the container right sidewall 118 along substantially curved edges, and the container bottom 120 intersects the container rear wall 114 along a substantially straight edge. The container front wall 112 and the container rear wall 114 lie in planes perpendicular to those of the container left sidewall 116 and the container right sidewall 118, the container front wall 112 lies in a plane parallel to that of the container rear wall 114, and the container left sidewall 116 lies in a plane parallel to that of the container right sidewall 118.

The container body 102 further includes a lip portion 122 extending around edges of an upper portion of each of the container front wall 112, the container rear wall 114, the container left sidewall 116, and the container right sidewall 118. The lip portion 122 further includes a first slot 124*a* in the portion of the lip portion 122 corresponding to the container left sidewall 116, and a second slot 124*b* in the portion of the lip portion 122 corresponding to the container right sidewall 118. Although the container body 102 illustrated in FIGS. 2A-2D is formed in a partial rectangular solid shape having one or more curved edges, it should be understood that in other examples, the container body 102 may be formed in a variety of shapes including cylindrical. In at least one form, the container body 102 is constructed of a plastic material. In still other forms, the container body 102 may be constructed of any suitable material.

Figure 3A:
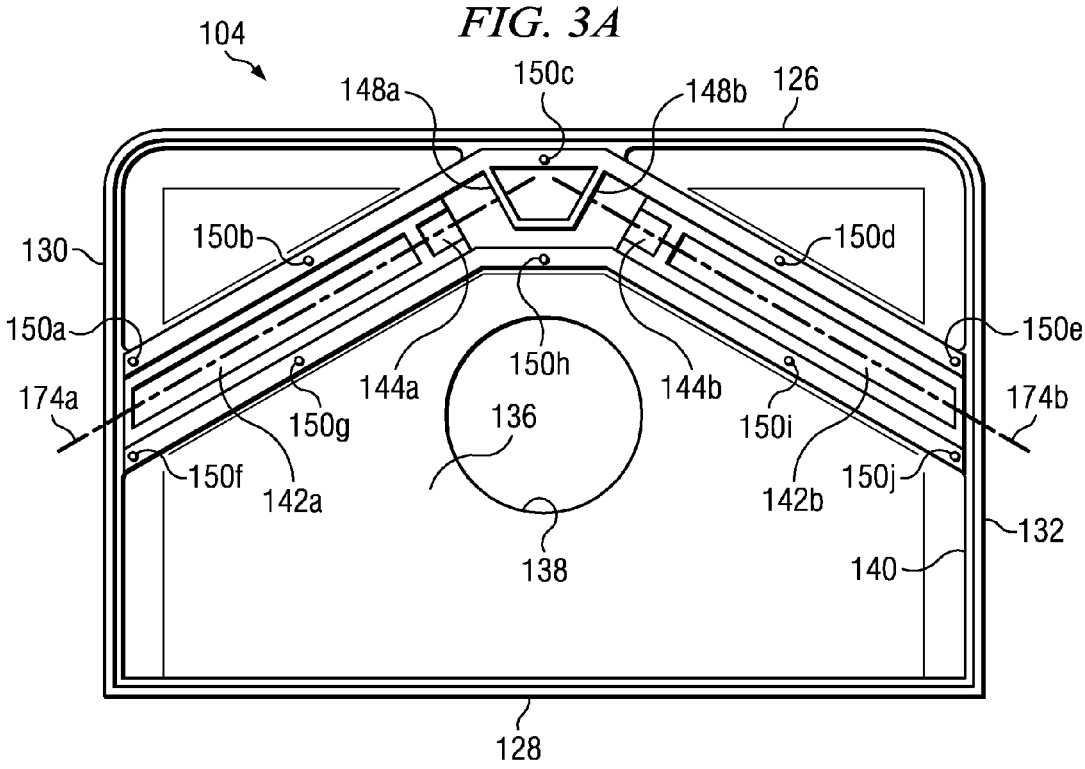
FIGS. 3A-3D illustrate the locking top of the fluid dispenser with interlocking top mechanism of FIG. 1.
Figure 3B:
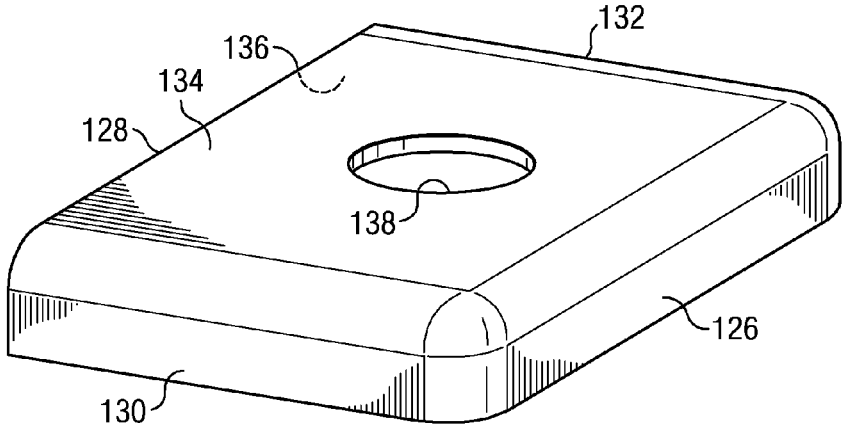

FIGS. 3A-3D illustrate the locking top 104 of the fluid dispenser with interlocking top mechanism 100 of FIG. 1. FIG. 3A illustrates a bottom view of the locking top 104. FIG. 3B illustrates a top perspective view of the locking top 104. The locking top includes a front edge wall 126, a rear edge wall 128, a left edge wall 130, a right edge wall 132, an outer top surface 134, and an inner top surface 136. In the example illustrated in FIGS. 3A-3D, the front edge wall 126 and the left edge wall 130 intersect along a substantially curved edge, and the front edge wall 126 and the right edge wall 132 intersect along a substantially curved edge. The rear edge wall 128 intersects the left edge wall 130 along a substantially straight edge, and the rear edge wall 128 intersects the right edge wall 132 along a substantially straight edge. The outer top surface 134 and the inner top surface 136 intersect the front edge wall 126, the rear edge wall 128, the left edge wall 130, and the right edge wall 132 at a substantially right angle. The outer top surface 134 and the inner top surface 136 further include a dispenser opening 138 therethrough. The dispenser opening 138 is configured to allow mounting of a dispensing spout, such as a pump, to facilitate dispensing of fluid contained within the container body 102.

The locking top 104 further includes a groove 140 extending along edges of the front edge wall 126, the rear edge wall 128, the left edge wall 130, and the right edge wall 132. The groove 140 is configured to mate with the lip portion 122 of the container body 102 when the locking top 104 is placed upon the container body 102. The inner top surface 136 of the locking top 104 further includes a first lock channel 142*a* thereon extending along a portion of a first axis 174*a*, and a second lock channel 142*b* thereon extending along a portion of a second axis 174*b*. In at least one example, the first axis 174*a* extends from a location on the front edge wall 126 to a location on the left edge wall 130, and the second axis 174*b* extends from a location on the front edge wall 126 to a location on the right edge wall 132. The first axis 174*a* extends from a center portion of the front edge wall 126 to a center portion of the left edge wall 130, and the second axis 174*b* extends from a center portion of the front edge wall 126 to a center portion of the right edge wall 132. In various examples, the first lock channel 142*a* and second lock channel 142*b* are disposed on the inner surface 136 of the locking top 104 to accommodate the dispenser opening 138.

Figure 3C:
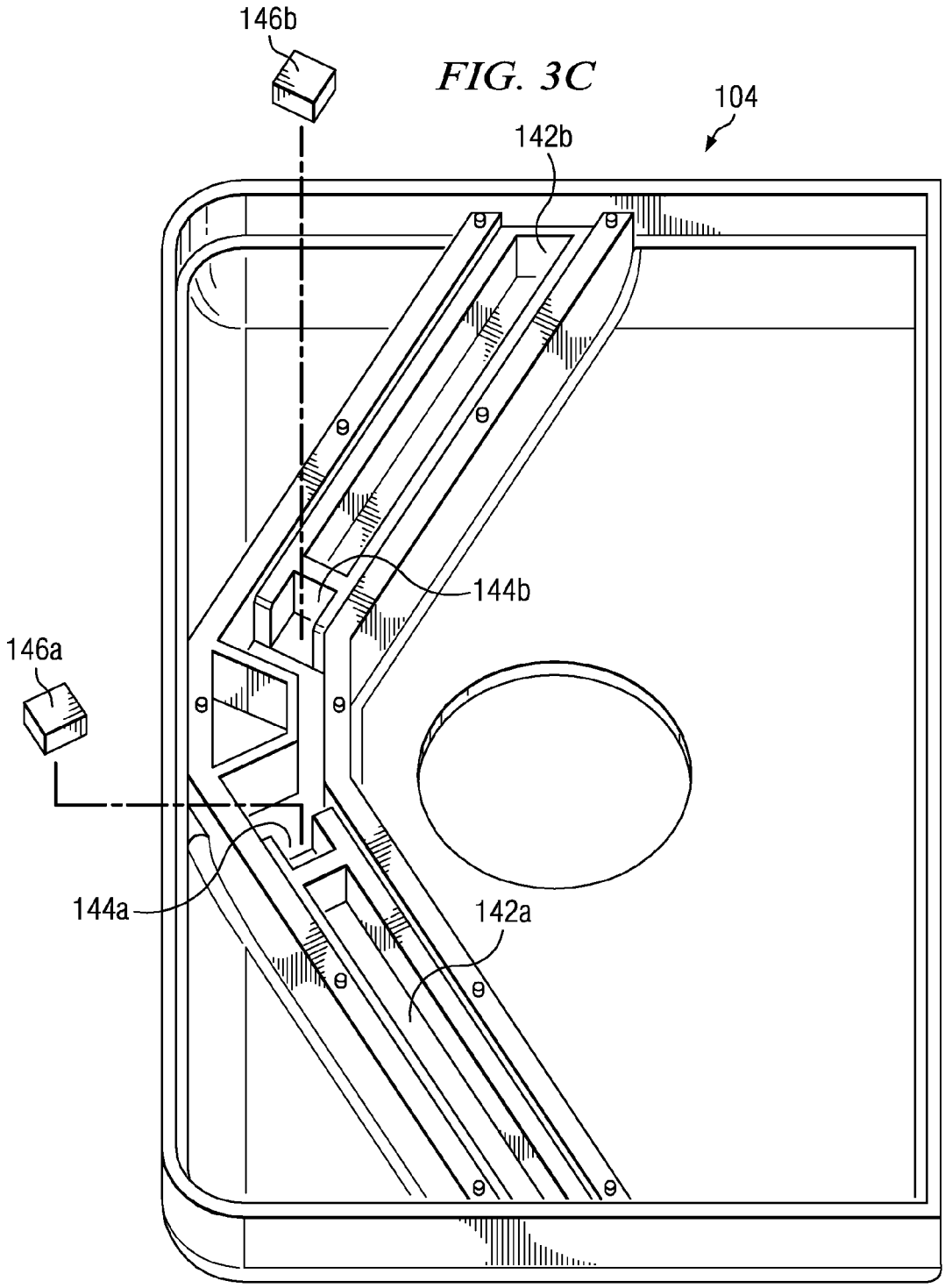
Figure 3D:
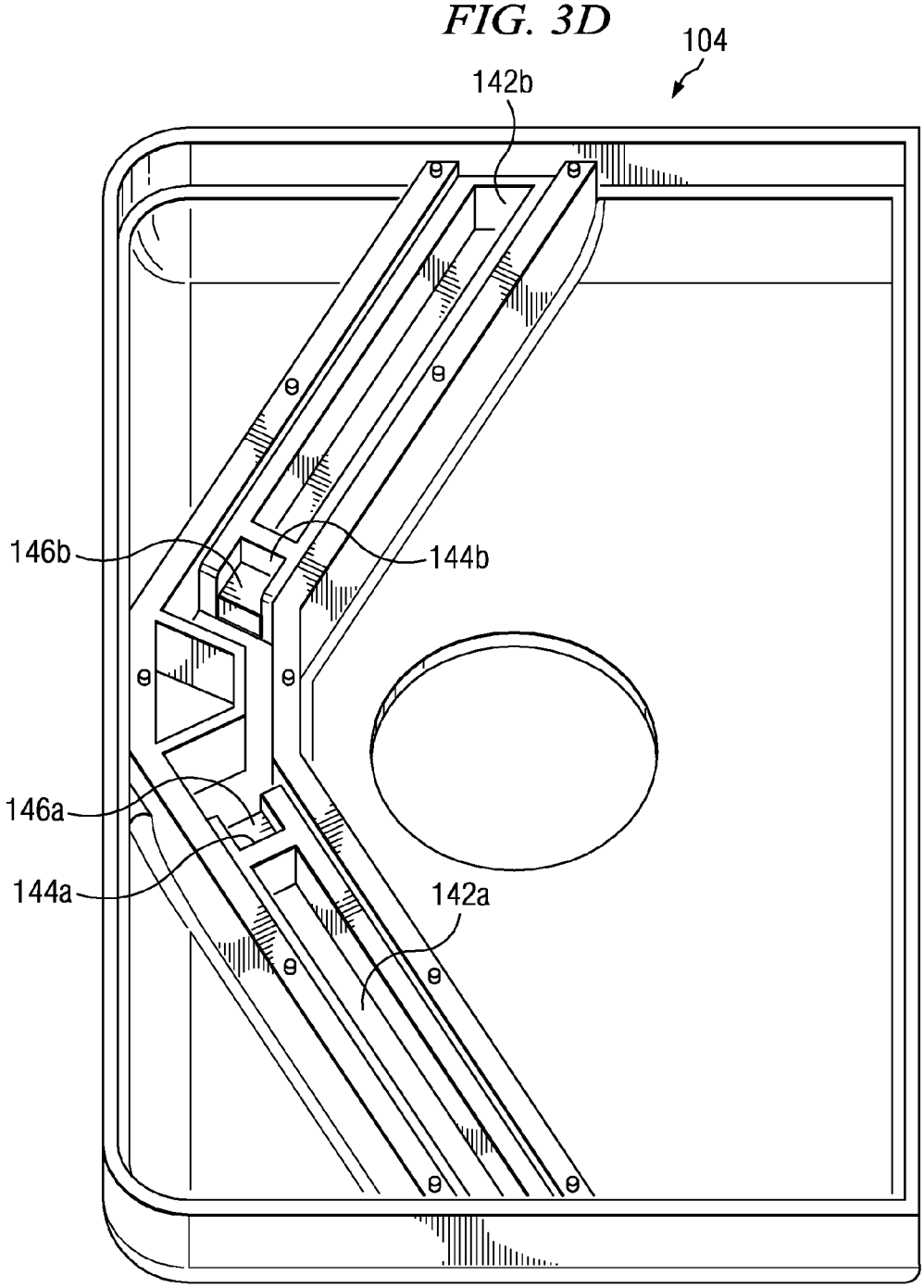

The locking top 104 further includes a first magnet recess 144*a* disposed at an end of the first lock channel 142*a* closest to the front edge wall 126, and a second magnet recess 144*b* disposed at an end of the second lock channel 142*b* closest to the front edge wall 126. The first magnet recess 144*a* and the second magnet recess 144*b* are substantially cubic in shape. The first magnet recess 144*a* and the second magnet recess 144*b* are each configured to receive a first top magnet 146*a* and a second top magnet 146*b*, respectively as illustrated in FIGS. 3C-3D. FIG. 3C illustrates an exploded perspective view of the locking top 104 and the first top magnet 146*a* and the second top magnet 146*b*. FIG. 3D illustrates the first top magnet 146*a* and the second top magnet 146*b* secured within the first magnet recess 144*a* and the second magnet recess 144*b*, respectively. The first top magnet 146*a* and the second top magnet 146*b* are substantially cubic in shape. The first top magnet 146*a* and the second top magnet 146*b* are 0.125 cubic inches in dimension. The first top magnet 146*a* and the second top magnet 146*b* are composed of rare earth magnetic material. The first top magnet 146*a* and the second top magnet 146*b* are composed of grade N45 neodymium iron boron magnetic material.

The locking top 104 further includes a first lock stop 148*a* disposed proximate to the end of the first lock channel 142*a* nearest to the front edge wall 126, and a second lock stop 148*b* disposed proximate to the end of the second lock channel 142*b* nearest to the front edge wall 126. The locking top 104 further includes a number of inside cover plate posts 150*a*-150*j* formed along edges of the first lock channel 142*a* and the second lock channel 142*b* to facilitate placement of the inside cover plate 106 over the first lock channel 142*a* and the second lock channel 142*b*. In at least one example, the locking top 104 is constructed of a plastic material. In still other examples, the locking top 104 may be constructed of any suitable material. Although the locking top 104 illustrated in FIGS. 3A-3D is formed in a substantially rectangular solid shape having one or more curved edges, it should be understood that in other forms, the locking top 104 may be formed in a variety of shapes, including a cylindrical shape.

Figure 4:
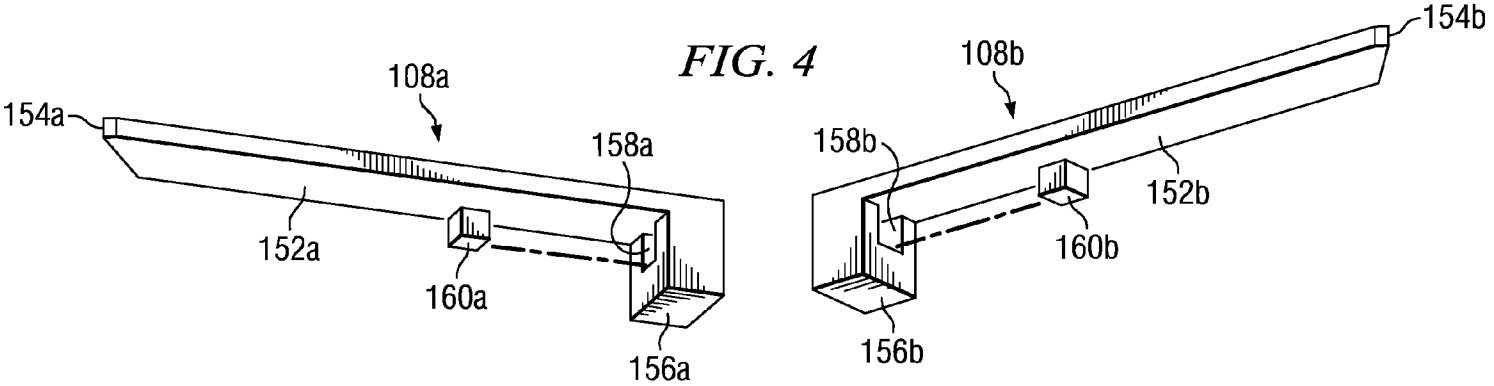
FIG. 4 illustrates the first sliding lock member and the second sliding lock member of FIG. 1.

FIG. 4 illustrates an exploded perspective view of the first sliding lock member 108*a* and the second sliding lock member 108*b* of FIG. 1. The first sliding lock member 108*a* includes a first sliding lock arm 152*a* having a first sliding lock arm tip 154*a* at a first end of the first sliding lock arm 152*a*, and a first sliding lock base 156*a* at a second end of the first sliding lock arm 152*a*. The first sliding lock base 156*a* includes a first lock arm magnet recess 158*a*. The second sliding lock member 108*b* includes a second sliding lock arm 152*b* having a second sliding lock arm tip 154*b* at a first end of the second sliding lock arm 152*b*, and a second sliding lock base 156*b* at a second end of the second sliding lock arm 152*b*. The second sliding lock base 156*b* includes a second lock arm magnet recess 158*b*. The first lock arm magnet 160*a* is inserted into the first lock arm magnet recess 158*a*, and the second lock arm magnet 160*b* is inserted into the second lock arm magnet recess 158*b*. In at least one example, the first lock arm magnet recess 158*a* and the second lock arm magnet recess 158*b* are substantially cubic in shape. In at least one example, the first lock arm magnet 160*a* and the second lock arm magnet 160*b* are substantially cubic in shape. In a particular example, the first lock arm magnet 160*a* and the second lock arm magnet 160*b* are 0.125 cubic inches in dimension. In at least one example, the first lock arm magnet 160*a* and the second lock arm magnet 160*b* are composed of rare earth magnetic material. In a particular example, the first lock arm magnet 160*a* and the second lock arm magnet 160*b* are composed of grade N45 neodymium iron boron magnetic material.

The first sliding lock arm 152*a* and the second sliding lock arm 152*b* are configured to be positioned within and slide along the first lock channel 142*a* and the second lock channel 142*b*, respectively. In at least one example, the first sliding lock base 156*a* is configured to be disposed between the first magnet recess 144*a* and the first lock stop 148*a* of the locking top 104, and the second sliding lock base 156*b* is configured to be disposed between the second magnet recess 144*b* and the second lock stop 148*b* of the locking top 104. The first sliding lock arm tip 154*a* and the second sliding lock arm tip 154*b* are configured to engage the first slot 124*a* and the second slot 124*b*, respectively, of the container body 102. The first lock arm magnet 160*a* and the first top magnet 146*a* are arranged such that opposite magnetic poles of the first lock arm magnet 160*a* and the first top magnet 146*a* are adjacent to one another to produce a first attractive magnetic force between the first lock arm magnet 160*a* and the first top magnet 146*a* to slide the first sliding lock member 108*a* into an engaged position. Similarly, the second lock arm magnet 160*b* and the second top magnet 146*b* are arranged such that opposite magnetic poles of the second lock arm magnet 160*b* and the second top magnet 146*b* are adjacent to one another to produce a second attractive magnetic force between the second lock arm magnet 160*b* and the second top magnet 146*b* to slide the second sliding lock member 108*b* into an engaged position. In at least one example, each of the first top magnet 146*a*, the second top magnet 146*b*, the first lock arm magnet 160*a*, and the second lock arm magnet 160*b* are oriented such that their North magnetic poles are pointed towards the front edge wall 126 of the locking top 104. In at least one example, the non-magnetic portions of the first sliding lock member 108*a* and the second sliding lock member 108*b* are formed of a plastic material. In still other examples, the non-magnetic portions of the first sliding lock member 108*a* and the second sliding lock member 108*b* may be formed of any suitable material such as a substantially non-magnetic metal.

Figure 5:
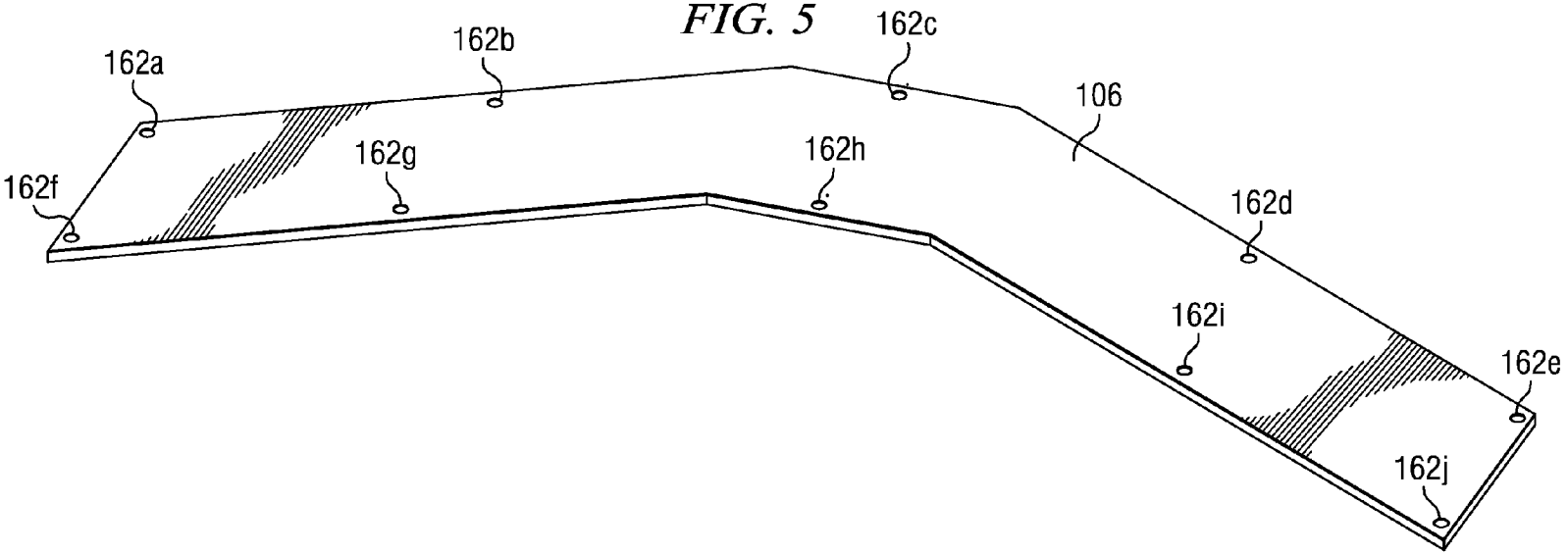
FIG. 5 illustrates the inside cover plate of FIG. 1.

FIG. 5 illustrates a perspective view of the inside cover plate 106 of FIG. 1. In the illustrated example, the inside cover plate 106 is formed of a substantially flat plate in the shape of an eight-sided polygon to cover one or more portions of the interlocking mechanism of the locking top 104. In at least one example, the inside cover plate 106 is configured to cover at least a portion of one or more of the first lock channel 142*a*, the second lock channel 142*b*, the first magnet recess 144*a*, the second magnet recess 144*b*, first lock stop 148*a*, and the second lock stop 148*b* of the locking top 104.

In the illustrated example, the inside cover plate 106 further includes a number of inside cover plate holes 162*a*-162*j* formed along edges of the inside cover plate 106. Each of the inside cover plate holes 162*a*-162*j* of the inside cover plate 106 are configured to engage with corresponding inside cover plate posts 150*a*-150*j* of the locking top 104 to facilitate fitment of the inside cover plate 106 over the first lock channel 142*a* and the second lock channel 142*b*. In at least one example, the inside cover plate 106 is ultrasonically welded to the locking top 104. In other examples, the inside cover plate 106 may be affixed to the locking top 104 using an adhesive or other fastening device. In various examples, the inside cover plate 106 at least partially seals the interlocking mechanism of the locking top 104 from contact with fluid contents contained within the container body 102. In at least one example, the inside cover plate 106 is constructed of a plastic material. In still other examples, the inside cover plate 106 may be constructed of any suitable material.

Figure 6:
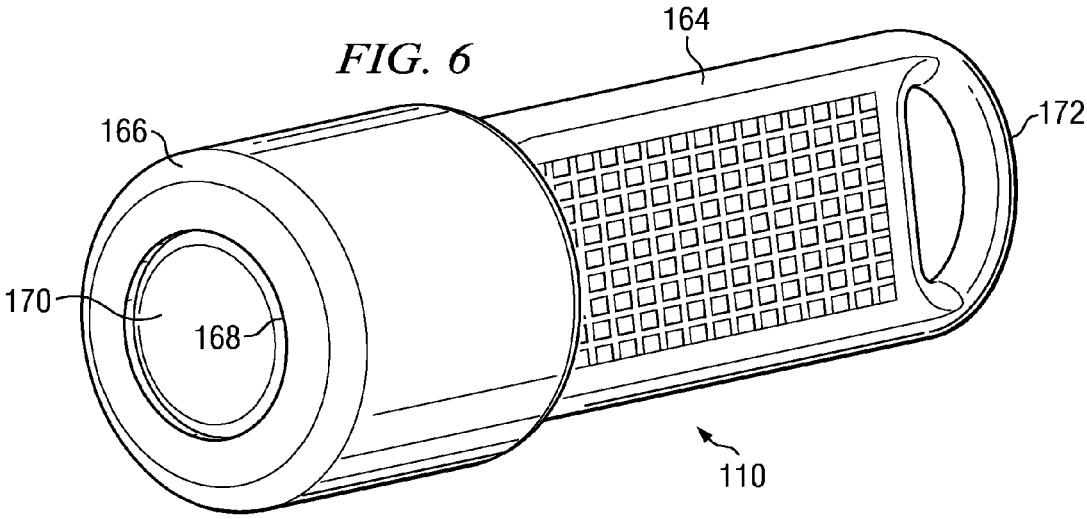
FIG. 6 illustrates the key fob of FIG. 1.

FIG. 6 illustrates a perspective view of the key fob 110 of FIG. 1. The key fob 110 includes a key handle portion 164, a key head portion 166, a key magnet recess 168, a key magnet 170, and a loop portion 172. In the illustrated example, the key head portion 166 is of a substantially cylindrical shape and the key handle portion 164 is of a substantially flat shape. The handle portion 164 is configured to facilitate gripping of the key fob 110 by a user. The key head portion 166 is disposed at a first end of the handle portion 164, and the loop portion 172 is disposed at a second end of the handle portion 164. The key head portion includes a key magnet recess 168 for affixing the key magnet 170 therein. In at least one example, the key magnet recess 168 and the key magnet 170 are cylindrical in shape. In at least one example, the key magnet 170 is affixed within the key magnet recess 168 using an adhesive, such as an epoxy adhesive, as is necessary to fill the space behind the key magnet 170 within the key magnet recess 168 to set the key magnet 170 within the key magnet recess 168. In a particular example, the key magnet 170 has dimensions of 0.5 inches in diameter and 0.5 inches in length. In at least one example, the key magnet 170 is composed of rare earth magnetic material. In a particular example, the key magnet 170 is composed of grade N45 neodymium iron boron magnetic material. In at least one example, the key magnet 170 is oriented within the key magnet recess 168 such that the South magnetic pole is pointed outwardly from the key fob 110. The loop portion 172 is configured to allow attachment of a key ring, a loop, a strap, or the like to the key fob 110 in order to facilitate carrying or storage of the key fob 110. In at least one example, the non-magnetic portions of the key fob 110 are formed of a plastic material. In still other examples, the non-magnetic portions of the key fob 110 may be formed of any suitable material such as a substantially non-magnetic metal. In still other examples, the key magnet recess 168 and/or key magnet 170 may be omitted and the entire key fob 110 may be constructed of a magnetic material such that a first end of key fob 110 may have a North magnetic pole and a second end of the key fob 110 may have a South magnetic pole.

Referring again to FIGS. 1-6, the fluid dispenser with interlocking top mechanism 100 may be constructed in one example by rigidly mounting the first top magnet 146*a* and the second top magnet 146*b* within the first magnet recess 144*a* and the second magnet recess 144*b* with their North magnetic holes oriented toward the front edge wall 126 using an adhesive. The first lock arm magnet 160*a* and the second lock arm magnet 160*b* may be mounted using an adhesive within the first lock arm magnet recess 158*a* and the second lock arm magnet recess 158*b*, respectively, with their North magnetic poles oriented away from the direction of the first sliding lock arm tip 154*a* and the second sliding lock arm tip 154*b* of the first sliding lock member 108*a* and the second sliding lock member 108*b*. The first sliding lock member 108*a* is placed within the first lock channel 142*a* of the locking top 104 with the first sliding lock base 156*a* proximate to the first magnet recess 144*a*. Similarly, the second sliding lock member 108*b* is placed within the second lock channel

142*b* of the locking top 104 with the second sliding lock base 156*b* proximate to the second magnet recess 144*b*. In various examples, a dry lubricant, such as graphite, may be applied within the first lock channel 142*a* and the second lock channel 142*b* and/or upon the first sliding lock member 108*a* and the second sliding lock member 108*b* to facilitate sliding of the first sliding lock member 108*a* and the second sliding lock member 108*b* within the first lock channel 142*a* and the second lock channel 142*b*, respectively. Accordingly, each of the first top magnet 146*a*, the second top magnet 146*b*, the first lock arm magnet 160*a*, and the second lock arm magnet 160*b* are oriented such that their North magnetic poles are pointed towards the front edge wall 126 of the locking top 104. The inside cover plate holes 162*a*-162*j* of the inside cover plate 106 are then positioned over the inside cover plate posts 150*a*-150*j* of the locking top 104, and the inside cover plate 106 is ultrasonically welded along its outside edges to the locking top 104.

Figure 7A:
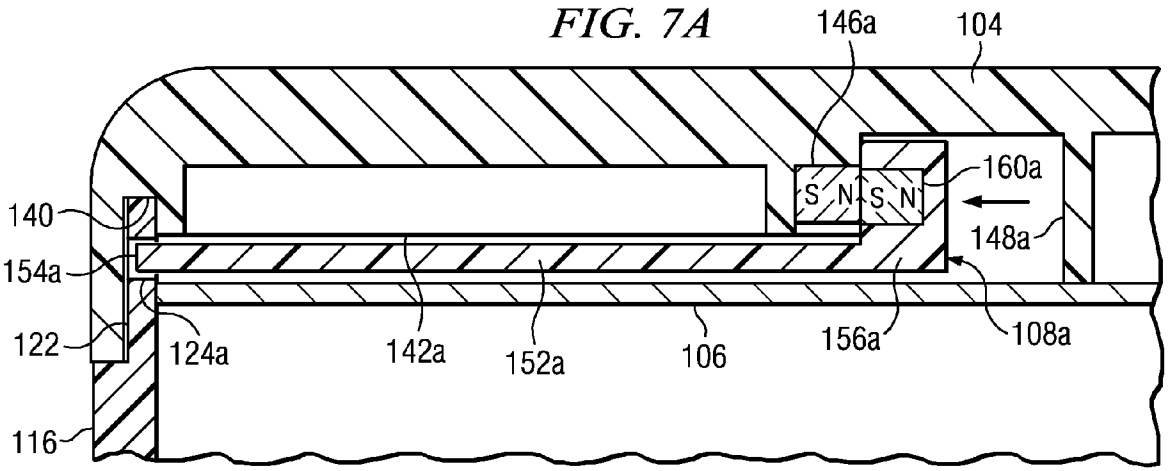
FIG. 7A illustrates a cross-sectional view of a portion of the fluid dispenser with interlocking top mechanism in a locked, or engaged, position.

FIG. 7A illustrates a cross-sectional view of a portion of the fluid dispenser with interlocking top mechanism 100 in a locked position. For greater clarity, only a left side portion of the fluid dispenser with interlocking top mechanism 100 is shown. In the locked, or engaged, position, the locking top 104 is mated with the container body 102 by engaging the lip portion 122 of the container body 102 with the groove 140 of the locking top 104. The North magnetic pole of the first top magnet 146*a* and the South magnetic pole of the first lock arm magnet 160*a* generate a first attractive magnet force between each other causing the first sliding lock base 156*a* of the first sliding lock member 108*a* to be drawn toward and held substantially against or proximate to the first magnet recess 144*a* of the locking top 104. As a result, the first sliding lock arm tip 154*a* of the first sliding lock arm 152*a* engages the first slot 124*a* of the container body 102. Although not shown in FIG. 8A, similarly the North magnetic pole of the second top magnet 146*b* and the South magnetic pole of the second lock arm magnet 160*b* generate a second attractive magnetic force between each other causing the second sliding lock base 156*b* of the second sliding lock member 108*b* to be drawn toward and held substantially against or proximate to the second magnet recess 144*b* of the locking top 104. Accordingly, the second sliding lock arm tip 154*b* of the second sliding lock arm 152*b* engages the second slot 124*b* of the container body 102. In the locked position, unauthorized users are prevented or deterred from removing the locking top 104 from the container body 102.

In an example, operation of placing the fluid dispenser with interlocking top mechanism 100 in a locked position, the lip portion 122 of the container body 102 is aligned by a user with the groove 140 of the locking top 104 and adequate downward pressure is applied so as to overcome the magnetic force holding the first top magnet 146*a* and the first lock arm magnet 160*a*, as well as the second top magnet 146*b* and the second lock arm magnet 160*b*, together. This allows the first sliding lock member 108*a* and the second sliding lock member 108*b* to slide toward the first lock stop 148*a* and second lock stop 148*b*, respectively. Upon the first sliding lock arm tip 154*a* and the second sliding lock arm tip 154*b* contacting the first slot 124*a* and the second slot 124*b*, respectively, of the container body 102, the first sliding lock arm tip 154*a* and the second sliding lock arm tip 154*b* snap into an engaged position with the first slot 124*a* and the second slot 124*b*. Accordingly, the fluid dispenser with interlocking top mechanism 100 is held in a locked position. In a particular example, the engagement of the first sliding lock arm tip 154*a* and the second sliding lock arm tip 154*b* may produce an audible sound, such as a click, to assure the user that the locking top 104 is in the locked position. In an alternative example, the first top magnet 146*a* and the second top magnet 146*b* may each be replaced with a spring mechanism or any other suitable mechanism configured to hold the first sliding lock member 108*a* and the second sliding lock member 108*b* in the locked position.

Figure 7B:
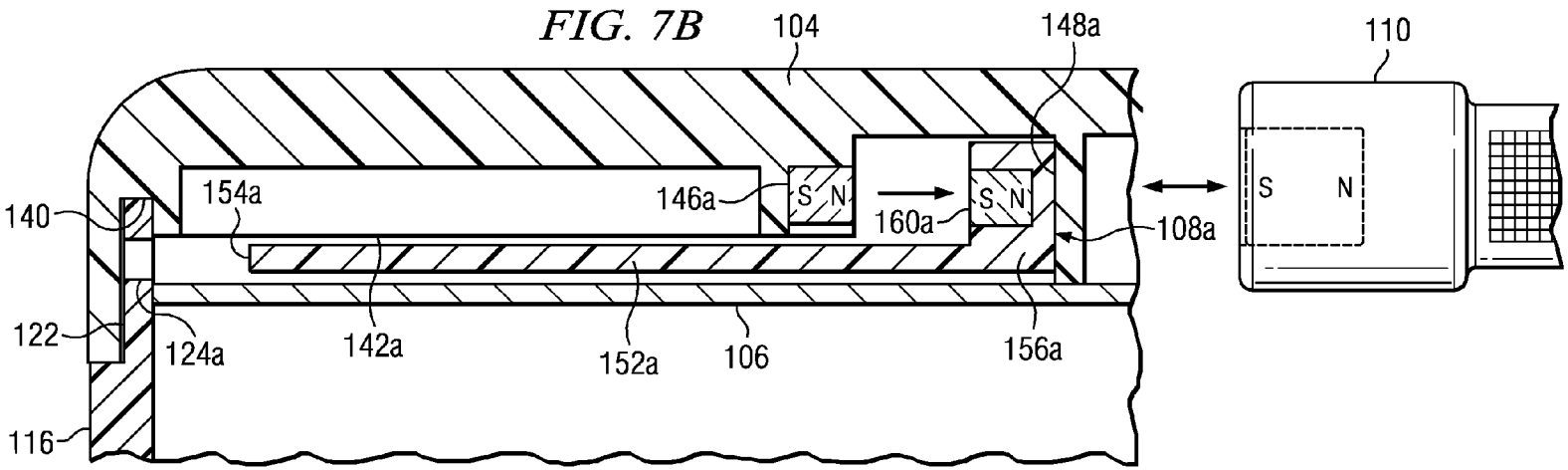
FIG. 7B illustrates a cross-sectional view of a portion of the fluid dispenser with interlocking top mechanism in an unlocked, or disengaged, position.

FIG. 7B illustrates a cross-sectional view of a portion of the fluid dispenser with interlocking top mechanism 100 in an unlocked, or disengaged, position. During an unlocking operation, the South magnetic pole of the key magnet 170 of the key fob 110 is placed in close proximity to or in direct contact with a substantially middle portion of the front edge wall 126 of the locking top 104. Accordingly, a third attractive magnetic force is generated between the key magnet 170 and the first lock arm magnet 160*a*, and a fourth attractive magnetic force is generated between the key magnet 170 and the second lock arm magnet 160*b*. The magnetic strength of the key magnet 170 is of such a magnitude that when the key fob 110 is placed proximate to the front edge wall 126 of the locking top 104, it overcomes the magnetic forces holding the first top magnet 146*a* to the first lock arm magnet 160*a*, as well as the second top magnet 146*b* to the second lock arm magnet 160*b*. As a result, the first sliding lock member 108*a* and the second sliding lock member 108*b* are pulled towards the key fob 110. In at least one example, the first sliding lock base 156*a* of the first sliding lock member 108*a* is pulled substantially in contact with the first lock stop 148*a*, and the second sliding lock base 156*b* of the second sliding lock member 108*b* is pulled substantially in contact with the second lock stop 148*b*. In at least one example, the magnetic attraction between the key magnet 170 and the first lock arm magnet 160*a* and the second lock arm magnet 160*b* is such that the key fob 110 will stay in place against the front edge wall 126 of the locking top 104 until pulled away by the user.

In an example operation of placing the fluid dispenser with interlocking top mechanism 100 in an unlocked position, the key fob 110 is placed at or near the center of the front edge wall 126 of the locking top 104 resulting in pulling of the first sliding lock member 108*a* and the second sliding lock member 108*b* out of engagement with the first slot 124*a* and the second slot 124*b* of the container body 102 by the magnetic attraction between the key magnet 170 and the first lock arm magnet 160*a* and the second lock arm magnet 160*b*. In a particular example, the disengagement of the first sliding lock member 108*a* and the second sliding lock member 108*b* may produce an audible sound, such as a click, to assure the user that the locking top 104 is in the unlocked position. The locking top 104 may then be removed from the container body 102 by the user in an upward motion. The key fob 110 may then either be removed from the locking top 104 by a sliding or pulling action, or alternately, left in place to enable easier reapplication of the locking top 104 to the container body 102.

Figure 8A:
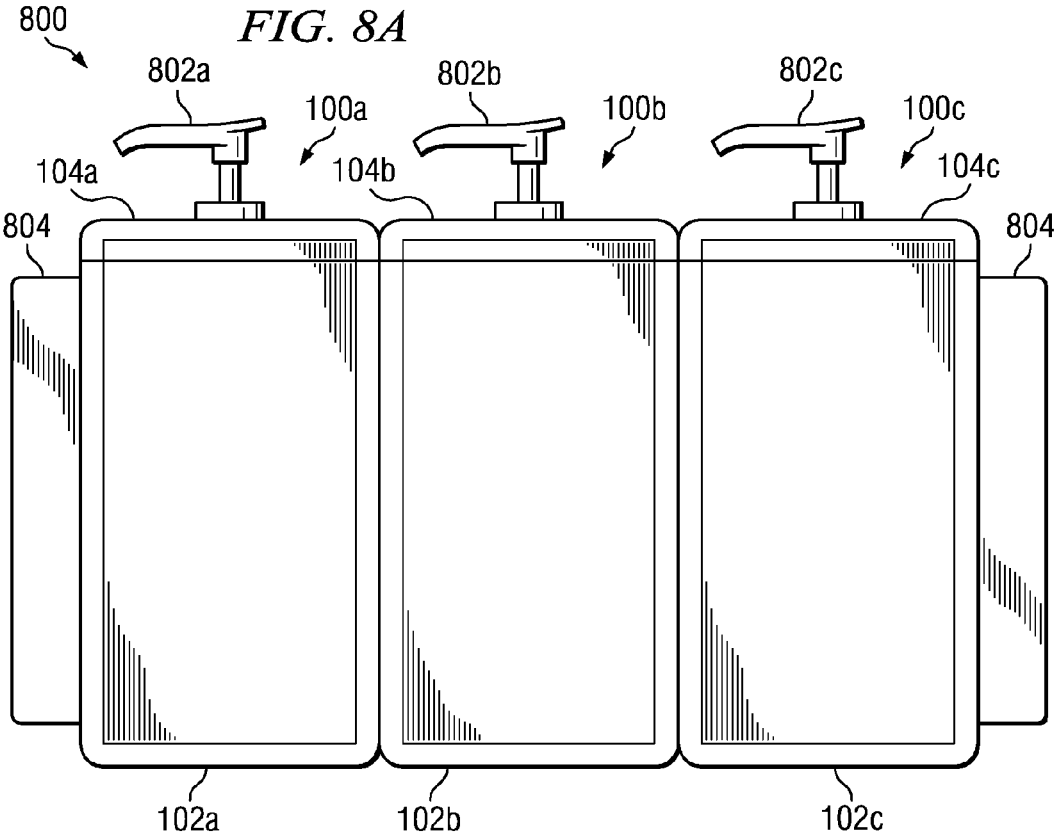
FIGS. 8A-8B illustrate a multi-container fluid dispenser including three fluid dispensers wherein each fluid dispenser has an interlocking top mechanism.
Figure 8B:
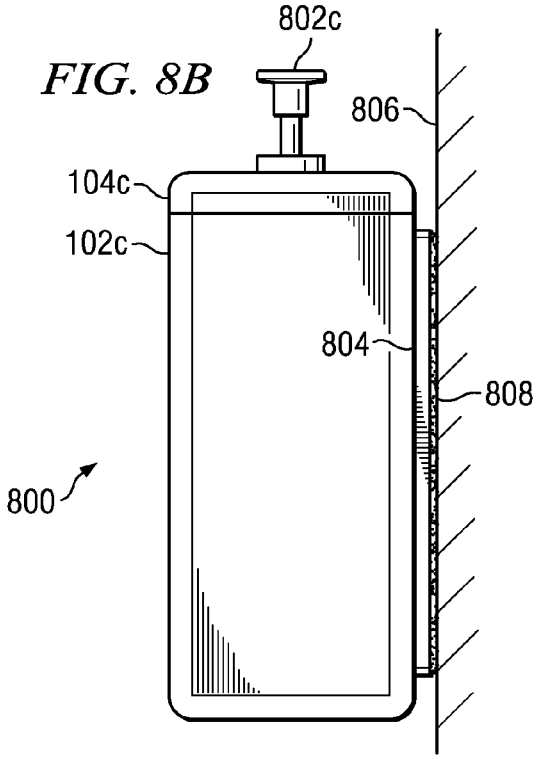

FIGS. 8A-8B illustrate an example of a multi-container fluid dispenser 800. FIG. 8A illustrates a front view of the multi-container fluid dispenser 800. FIG. 8B illustrates a side view of the multi-container fluid dispenser 800. The multi-container dispenser 800 includes a first fluid dispenser with interlocking top mechanism 100*a*, a second fluid dispenser with interlocking top mechanism 100*b*, and a third fluid dispenser with interlocking top mechanism 100*c*. In various examples, the first fluid dispenser 100*a*, the second fluid dispenser 100*b*, and the third fluid dispenser 100*c* are each constructed in substantially the same or a similar manner as the fluid dispenser with interlocking top mechanism 100 described with respect to FIGS. 1-7B. A first container body 102*a* of the first fluid dispenser 100*a*, a second container body

102*b* of the second fluid dispenser 100*b*, and a third container body 102*c* of the third fluid dispenser 100*c* are configured to hold fluids that are desired to be dispensed. As illustrated in FIG. 8, the first fluid dispenser 100*a*, the second fluid dispenser 100*b*, and the third fluid dispenser 100*c* are arranged in a side-to-side configuration. The first fluid dispenser 100*a* includes a first dispensing spout 802*a* mounted through a first locking top 104*a*. Similarly, the second fluid dispenser 100*b* includes a second dispensing spout 802*b* mounted through a second locking top 104*b*, and the third fluid dispenser 100*c* includes a third dispensing spout 802*c* mounted through a third locking top 104*c*. The first dispensing spout 802*a*, the second dispensing spout 802*b*, and the third dispensing spout 802*c* are configured to facilitate dispensing of fluid contained within the first container body 102*a*, the second container body 102*b*, and the third container body 102*c*, respectively.

In the illustrated example, the first fluid dispenser 100*a*, the second fluid dispenser 100*b*, and the third fluid dispenser 100*c* are mounted to a vertical mounting plate 804. The vertical mounting plate 804 facilitates mounting of the multi-container fluid dispenser 800 to a substantially vertical surface 806. In at least one example, the vertical mounting plate 804 is mounted to the vertical surface 806 via an adhesive material 808. In a particular example, the adhesive material 808 comprises double-sided adhesive tape. In still other examples, the vertical mounting plate 804 may be mounted to the vertical surface 806 using any suitable fastening method or device. Although in the illustrated example the multi-container fluid dispenser 800 is mounted to a vertical surface, in still other examples the multi-container fluid dispenser 800 may be placed upon or mounted to a horizontal surface or any other suitable mounting surface.

In at least one example of the multi-container fluid dispenser 800, each of the first fluid dispenser 100*a*, the second fluid dispenser 100*b*, and the third fluid dispenser 100*c* may be unlocked by application of a key fob 110 to the front side of the first locking top 104*a*, the second locking top 104*b*, and third locking top 104*c*, respectively. As shown in FIGS. 8A-8B, due to the proximity of the first fluid dispenser 100*a*, the second fluid dispenser 100*b*, and the third fluid dispenser 100*c* to each other, the right side of the front locking top 104*a*, the left and right sides of the second locking top 104*b*, and the left side of the third locking top 104*c* are not easily accessible by a user. In addition, due to the closeness of the first fluid dispenser 100*a*, the second fluid dispenser 100*b*, and the third fluid dispenser 100*c* to the vertical surface 806, the back sides of the first fluid dispenser 100*a*, the second fluid dispenser 100*b*, and the third fluid dispenser 100*c* are not easily accessible. In various examples, it may be difficult for a user to lift the first locking top 104*a*, the second locking top 104*b*, and the third locking top 104*c* in any direction other than a vertical one to remove them from the first container body 102*a*, the second container body 102*b*, and the third container body 102*c*. The capability provided in various examples of unlocking each of the first locking top 104*a*, the second locking top 104*b*, and the third locking top 104*c* by placing the key fob 110 in contact with or proximate to the front side of each of the first locking top 104*a*, the second locking top 104*b*, and the third locking top 104*c* allows a user to lift each of the first locking top 104*a*, the second locking top 104*b*, and the third locking top 104*c* in a substantially vertical direction to remove them from the first container body 102*a*, the second container body 102*b*, and the third container body 102*c*, respectively. Although the example of the multi-container fluid dispenser 800 illustrated in FIGS. 8A-8B include three fluid dispensers 100*a*-100*c*, it should be understood that other examples may include two or more fluid dispensers. Additionally, although the example illustrated in FIGS. 8A-8B includes the fluid dispensers 100*a*-100*c* arranged in a side-to-side manner, it should be understood that in other examples, the multi-container fluid dispenser 800 may include fluid dispensers 100*a*-100*c* arranged in a variety of configurations.

Figure 9:
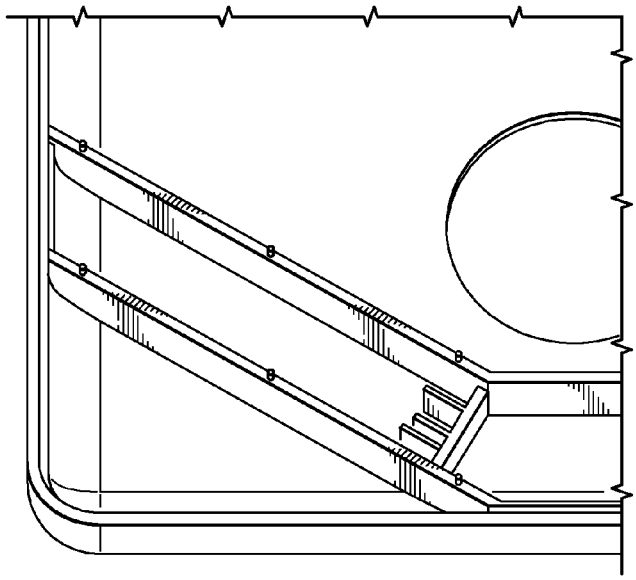
FIG. 9 illustrates a perspective view of an alternate form of the first lock channel.
Figure 10:
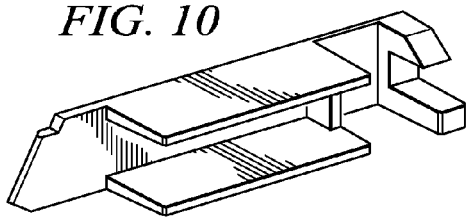
FIG. 10 illustrates a perspective view of an alternate form of the first sliding lock member.

FIG. 9 illustrates a perspective view of an alternate example of the first lock channel 142*a*. FIG. 10 illustrates a perspective view of an alternate example of the first sliding lock member 108*a*.

It will be appreciated by those skilled in the art having the benefit of this disclosure that embodiments of this interlocking mechanism for a fluid dispenser provides a magnetic lock to prevent or discourage unauthorized access to contents of the fluid dispenser. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and examples apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An interlocking mechanism for a fluid dispenser comprising:

a container body including at least one sidewall having a first slot therein;

a top portion including:

at least a first lock channel positioned along a portion of an inner surface thereof; and a first magnet disposed on the inner surface adjacent to the first lock channel;

a first sliding lock member positioned within and slidable along the first lock channel, the first sliding lock member having a tip portion configured to engage and disengage with the first slot, and a base portion having a third magnet disposed therein;

wherein a first attractive magnetic force is applied between the first magnet and the third magnet to slide the first sliding lock member into an engaged position with the first slot; and wherein an external magnetic force can break the first attractive magnetic force and urge the third magnet away from the first magnet and disengage the tip portion of the first sliding lock member from the first slot.

2. The interlocking mechanism of claim 1 and further comprising:

a second sidewall contained in the container body having a second slot therein;

the top portion further including:

a second lock channel positioned along a portion of the inner surface;

a second magnet disposed on the inner surface adjacent to the second lock channel;

a second sliding lock member positioned within and slidable along the second lock channel, the second sliding lock member having a tip portion configured to be engaged and disengaged with the second slot, and a base portion having a fourth magnet disposed therein;

wherein a second attractive magnetic force is applied between the second magnet and the fourth magnet to slide the first sliding lock member into an engaged position with the second slot; and wherein the external magnetic force can break the second attractive magnetic force and urge the fourth magnet away from the second magnet and disengage the tip portion of the second sliding lock member from the second slot.

3. The interlocking mechanism of claim 2 further comprising:

a key fob including a fifth magnet configured to apply the external attractive magnetic force between the fifth magnet and the third magnet to slide the first sliding lock member into a disengaged position from the first slot, and apply a fourth attractive magnetic force between the fifth magnet and the fourth magnet to slide the second sliding lock member into a disengaged position with the second slot.

4. The interlocking mechanism of claim 2, wherein the first lock channel is positioned along a portion of a first axis extending from a first edge wall of the top portion to a second edge wall of the top portion.

5. The interlocking mechanism of claim 4, wherein the second lock channel is positioned along a portion of a second axis extending from a first edge wall of the top portion to a third edge wall of the top portion.

6. The interlocking mechanism of claim 5, wherein the first edge wall is a front edge wall, the second edge wall is a left edge wall, and the third edge wall is a right edge wall.

7. The interlocking mechanism of claim 2, wherein the inner surface of the top portion further includes a first magnet recess adjacent to the first lock channel, the first magnet disposed within the first magnet recess.

8. The interlocking mechanism of claim 2, wherein the inner surface of the top portion further includes a second magnet recess adjacent to the second lock channel, the second magnet disposed within the second magnet recess.

9. The interlocking mechanism of claim 2, wherein the base portion of the first sliding lock member includes a third magnet recess, the third magnet disposed within the third magnet recess.

10. The interlocking mechanism of claim 2, wherein the base portion of the second sliding lock member includes a fourth magnet recess, the fourth magnet disposed within the fourth magnet recess.

11. The interlocking mechanism of claim 2, wherein the top portion further includes a dispenser opening therethrough.

12. The interlocking mechanism of claim 5, wherein the top portion further includes a first lock stop disposed proximate to an end of the first lock channel and the first edge wall, and a second lock stop disposed proximate to an end of the second lock channel and the first edge wall.

13. The interlocking mechanism of claim 12, wherein the base portion of the first sliding lock member is in substantial contact with the first lock stop when the first sliding lock member is in a disengaged position from the first slot, and the base portion of the second sliding lock member is in substantial contact with the second lock stop when the second sliding lock member is in a disengaged position from the second slot.

14. The interlocking mechanism of claim 2, wherein the top portion further includes a groove and the container body includes a lip portion, the groove configured to mate with the lip portion when the top portion is placed upon the container body.

15. The interlocking mechanism of claim 2 further comprising:

a cover plate configured to cover at least a portion of one or more of the first lock channel and the second lock channel of the top portion.

* * * * *